US005233850A

United States Patent [19]

Schroeder

[11] Patent Number: 5,233,850

[45] Date of Patent: Aug. 10, 1993

[54] REKEYABLE LOCK SYSTEM

[76] Inventor: Marc Schroeder, 250 Farhan La., North Babylon, N.Y. 11703

[21] Appl. No.: 829,449

[22] Filed: Feb. 3, 1992

[51] Int. Cl.[5] ..... E05B 25/00

[52] U.S. Cl. ..... 70/337; 70/359; 70/384; 70/DIG. 63

[58] Field of Search ..... 70/337-343, 70/359, 382-385, DIG. 44, DIG. 63, DIG. 71

[56] References Cited

U.S. PATENT DOCUMENTS

| | | | |
|---|---|---|---|
| 1,004,904 | 10/1911 | Rees | 70/382 |
| 1,244,304 | 10/1917 | Epstein | 70/359 |
| 2,970,466 | 2/1961 | Wellekens | 70/382 |
| 3,667,262 | 6/1972 | Hill | 70/384 |
| 3,813,905 | 6/1974 | Sauder | 70/383 X |
| 4,116,026 | 9/1978 | Flint | 70/383 |
| 4,372,139 | 2/1983 | Laake | 70/383 |

*Primary Examiner*—Lloyd A. Gall
*Attorney, Agent, or Firm*—Michael I. Kroll

[57] ABSTRACT

A rekeyable lock which includes a master lock activated by a master lock key, a rekeyable lock adjacent the master lock having a lock mechanism activated by a keyable lock key, and structure operably extending from the master lock to the rekeyable lock for changing the length of the lock mechanism within the rekeyable lock so that a different rekeyable lock key can be utilized to operate the rekeyable lock.

4 Claims, 4 Drawing Sheets

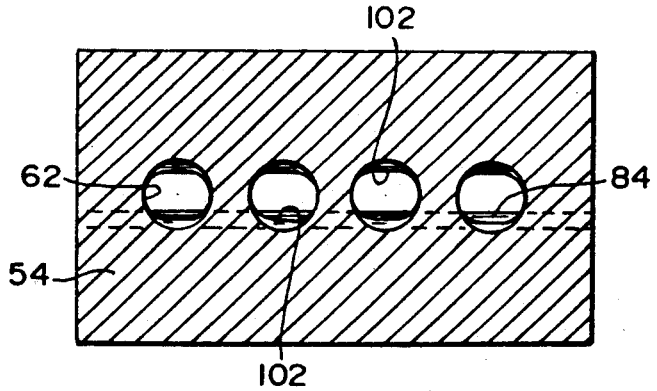
Fig. 6A
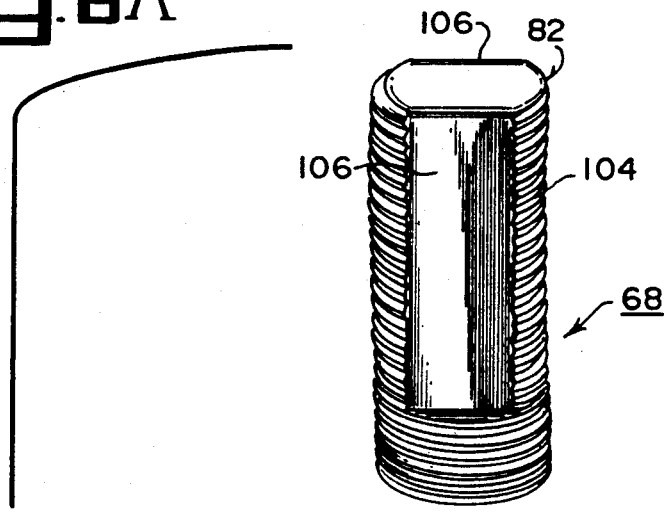
Fig. 6B
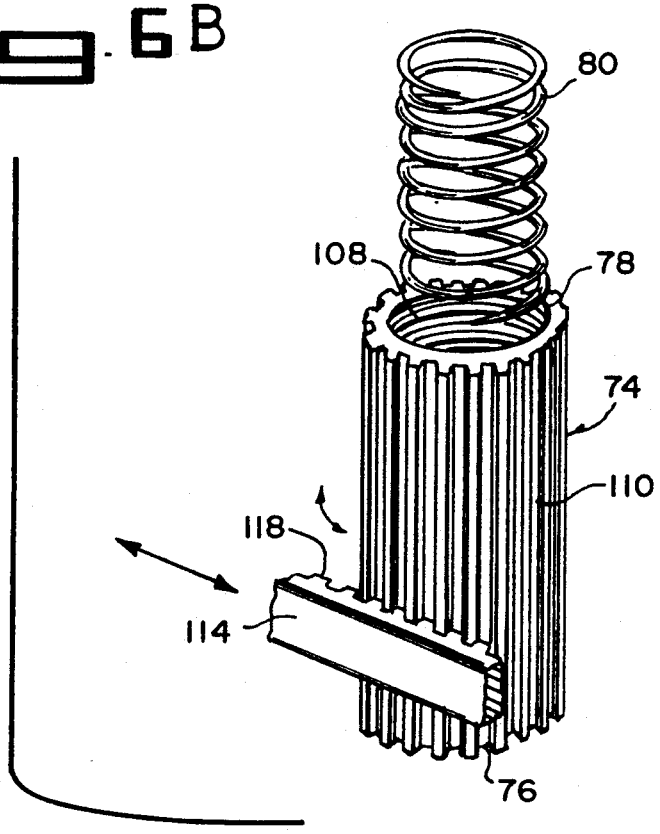

68
106
74
80
110
78
76
82
104
108
106

76
80
118
68
104
114
106
11
11
82
110
74
78

54
62
110
68
74
118
114

24
20
STEP 1
30
36
28
22
32
74
106
110
104
108
82
108
68
106

28
32
20
26
40
24
30
22
STEP 2
22
40
20
24
32
NEW KEY
36
36
ORIGINAL KEY
30
STEP 3

REKEYABLE LOCK SYSTEM

BACKGROUND OF THE INVENTION

1. Field of the Invention

The instant invention relates generally to locks and more specifically it relates to a rekeyable lock system.

2. Description of the Prior Art

Numerous locks have been provided in prior art that are adapted to secure doors which are movable structures that close off entrances, by the operation of keys, combinations or the like. While these units may be suitable for the particular purpose to which they address, they would not be as suitable for the purposes of the present invention as heretofore described.

SUMMARY OF THE INVENTION

A primary object of the present invention is to provide a rekeyable lock system that will overcome the shortcomings of the prior art devices.

Another object is to provide a rekeyable lock system that contains a mechanism which will allow a person to change the lengths of the tumbler pins in a rekeyable lock, so that a different rekeyable lock key can be used to operate the rekeyable lock.

An additional object is to provide a rekeyable lock system in which the mechanism includes a master lock which when operated will allow the tumbler pins located in a rekeyable lock to be reset by a different new rekeyable lock key when inserted therein.

A further object is to provide a rekeyable lock system that is simple and easy to use.

A still further object is to provide a rekeyable lock system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 6A is a cross sectional view taken along line 6A—6A in FIG. 6, through the bores in just the rekeyable lock barrel.

FIG. 6B is an enlarged inverted exploded perspective view of one of the lower pin assemblies.

DETAILED DESCRIPTION OF THE PREFERRED EMBODIMENTS

Figure 1:
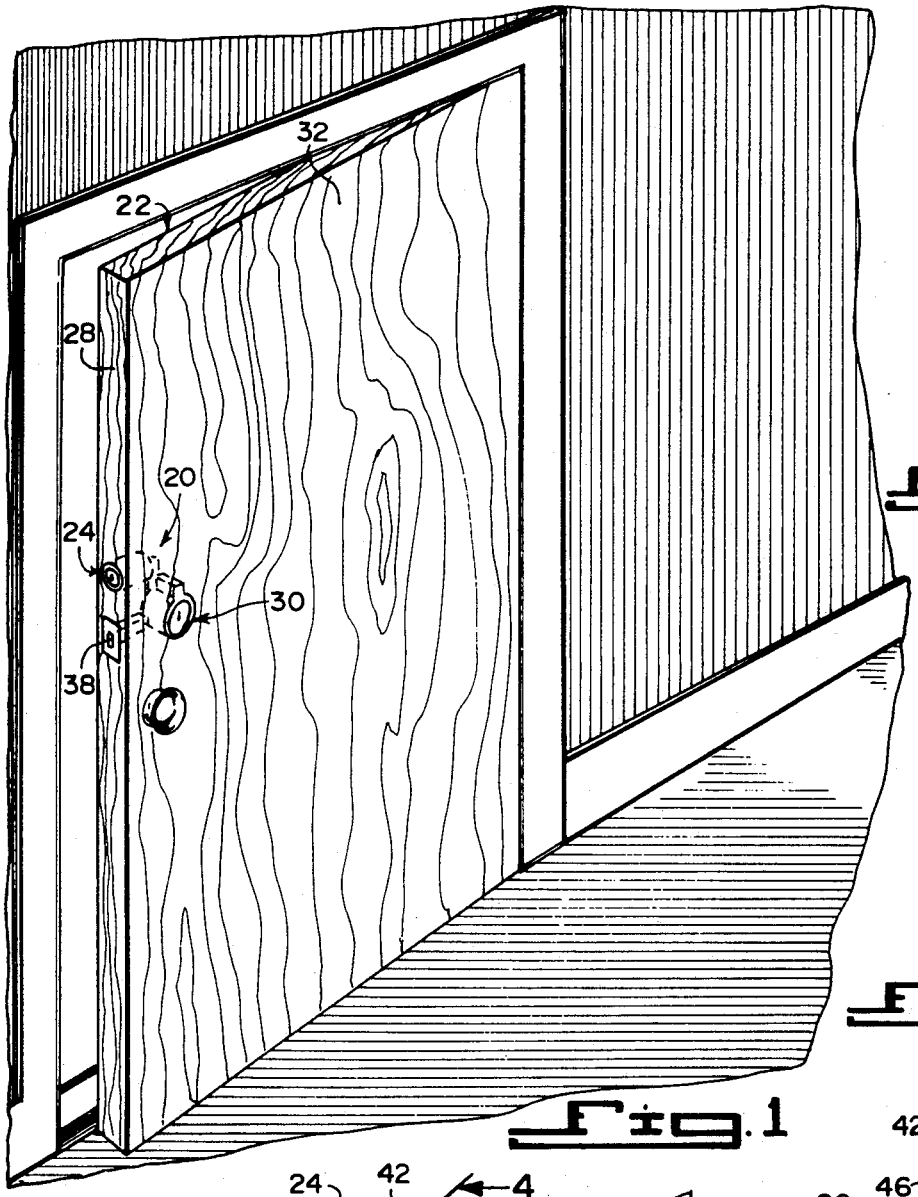
FIG. 1 is a perspective view of a door with the instant invention installed therein.
Figure 1A:
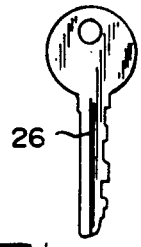
FIG. 1A is a plan view of the master lock key.
Figure 1B:
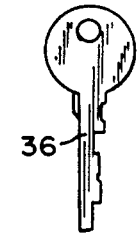
FIG. 1B is a plan view of the rekeyable lock key.
Figure 2:
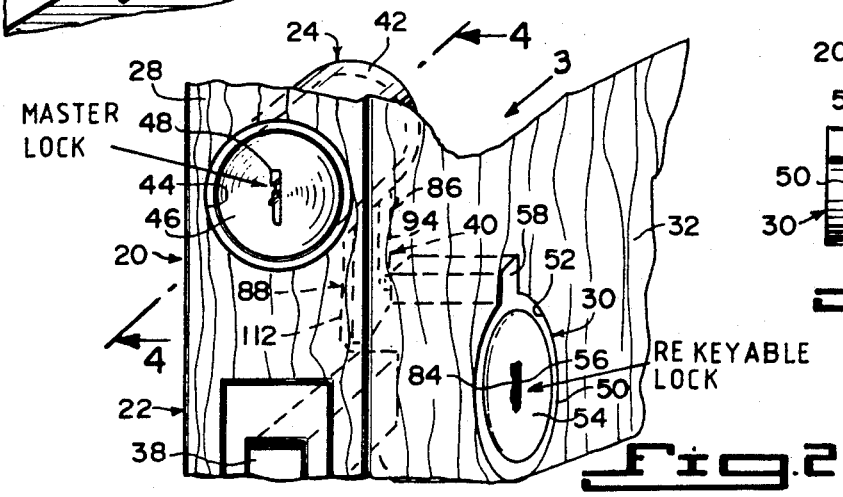
FIG. 2 is an enlarged perspective view of a portion of the door in FIG. 1, showing the master lock and rekeyable lock in greater detail.
Figure 3:
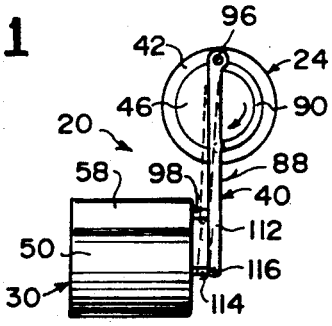
FIG. 3 is an elevational view of just the master lock and rekeyable lock per se taken in direction of arrow 3 in FIG. 2.
Figure 4:
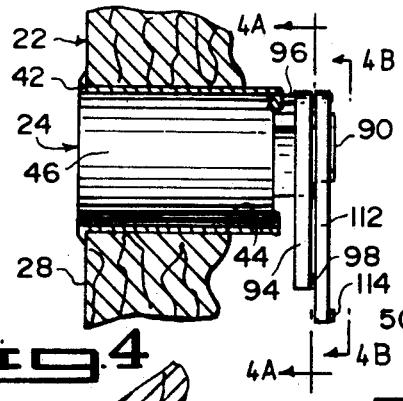
FIG. 4 is a cross sectional view taken along line 4—4 in FIG. 2, of just the master lock in the door.
Figure 4A:
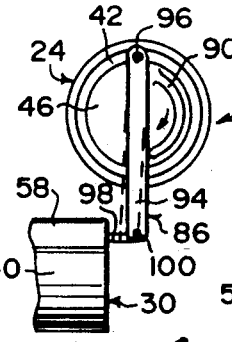
FIG. 4A is a cross sectional view taken along line 4A—4A in FIG. 4, with the door removed.
Figure 4B:
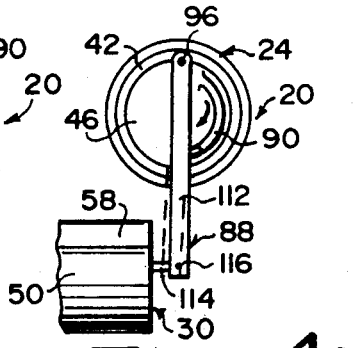
FIG. 4B is an end view taken along line 4B—4B in FIG. 4, with the door removed.
Figure 5:
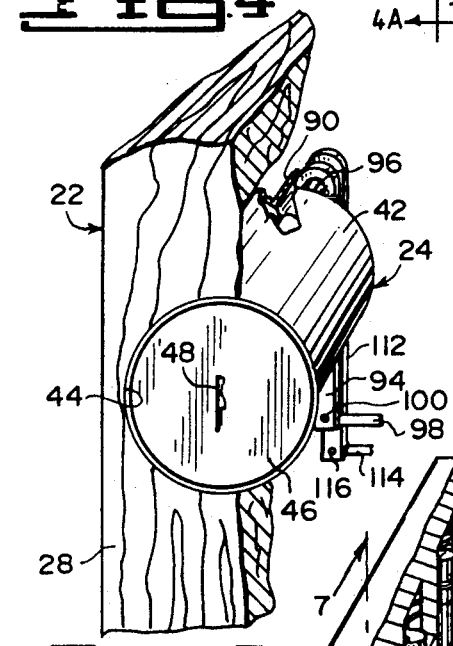
FIG. 5 is a perspective view similar to FIG. 2 of just the master lock with parts broken away.
Figure 7:
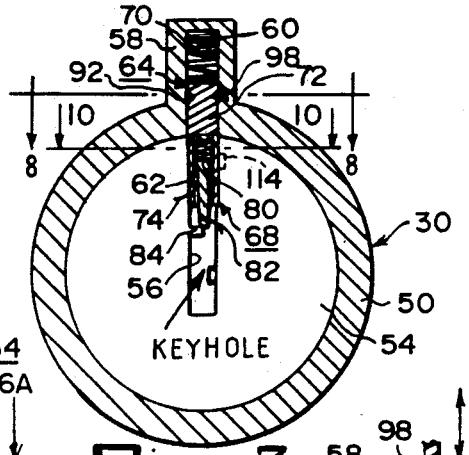
FIG. 7 is a diagrammatic cross sectional view taken along line 7—7 in FIG. 6.
Figure 6:
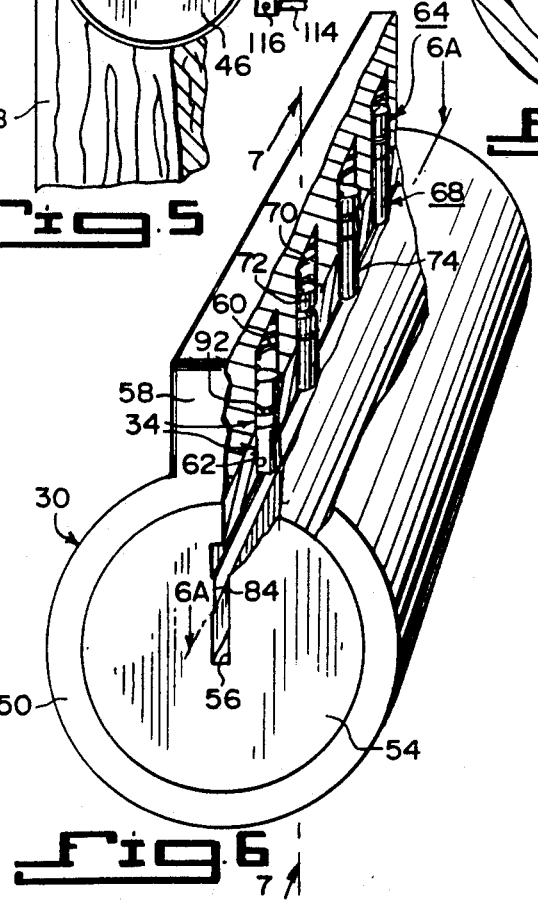
FIG. 6 is a perspective view of the rekeyable lock with parts broken away.
Figure 8:
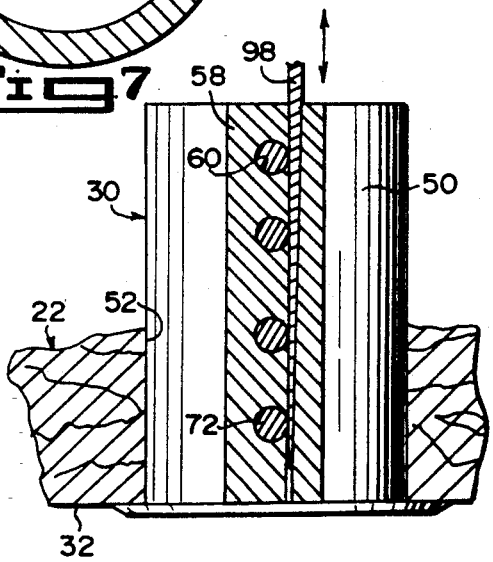
FIG. 8 is a diagrammatic cross sectional view taken along line 8—8 in FIG. 7.

Turning now descriptively to the drawings, in which similar reference characters denote similar elements throughout the several views, the Figures illustrate a rekeyable lock system 20, such as in a door 22, which consists of a master lock 24 activated by a master lock key 26 mounted within a side edge 28 of the door 22. A rekeyable lock 30 is mounted within a face 32 of the door 22 adjacent the master lock 24. The rekeyable lock 30 has a lock mechanism 34 (see FIG. 6) activated by a rekeyable lock key 36 for operating a dead bolt 38 within the side edge 28 of the door 22 below the master lock 24. A structure 40 operably extends from the master lock 24 to the rekeyable lock, 30 for changing the length of the lock mechanism 34 within the rekeyable lock 30, so that a different rekeyable lock key 36 can be utilized to operate the rekeyable lock 30.

The master lock 24 includes a cylinder 42 which fits into an aperture 44 in the side edge 28 of the door 22 and a barrel 46 which fits into the cylinder 42. The barrel 46 has a longitudinal keyhole 48, so that the master lock key 26 can be inserted into the keyhole 48 in the barrel 46 to rotate within the cylinder 42.

The rekeyable lock 30 includes a cylinder 50 which fits into an aperture 52 in the face 32 of the door 22 and a barrel 54 which fits into the cylinder 50. The barrel 54 has a longitudinal keyhole 56, so that the rekeyable lock key 36 can be inserted into the keyhole 56 in the barrel 54 to rotate within the cylinder 50.

The lock mechanism 34 within the rekeyable lock 30 includes a shell portion 58 formed along a top segment of the rekeyable lock cylinder 50. The shell portion 58 has a plurality of spaced apart latitudinal bores 60 therealong. The rekeyable lock barrel 54 has a plurality of spaced apart latitudinal bores 62 therealong in alignment with the latitudinal bores 60 in the rekeyable lock cylinder 50. Each of the rekeyable lock barrel bores 62 intersect with the longitudinal keyhole 56 in said rekeyable lock barrel 54. A plurality of upper pin assemblies 64 are provided, with each placed within a bore 60 in the shell portion 58. A plurality of lower pin assemblies 68 are also provided, with each placed within a bore 62 in the rekeyable lock barrel 54. When the proper rekeyable lock key 36 is inserted into the keyhole 56 in the rekeyable lock barrel 54, the upper pin assemblies 64 and the lower pin assemblies 68 will be in their proper positions to allow the rekeyable lock barrel 54 to rotate within the rekeyable lock cylinder 50 to operate the dead bolt 38 in the door 22.

Each upper pin assembly 64 includes a spring 70 insertable into a respective bore 60 in the shell portion 58 of the rekeyable lock cylinder 50. A driver pin 72 is insertable into the respective bore 60 in the shell portion 58 of the rekeyable lock cylinder 50 against the spring 70.

Each lower pin assembly 68 includes a sleeve 74 having a closed top end 76 and an open bottom end 78. The sleeve 74 is insertable into a respective bore 62 in the rekeyable lock barrel 54. A spring 80 is insertable into the open bottom end 78 of the sleeve 74. A tumbler pin 82 is insertable into the open bottom end 78 of the sleeve 74 against the spring 80, so that the tumbler pin 82 can extend downwardly into the keyhole 56 in the rekeyable lock barrel 54.

An elongated seat 84 is formed within one side of the keyhole 56 in the rekeyable lock barrel 54 to prevent the lower pin assemblies 68 from dropping completely down their respective bores 62 into the keyhole 56 in the rekeyable lock barrel 54.

The lock mechanism changing structure 40 includes a first apparatus 86 for locking and unlocking the driver pins 72 simultaneously when the proper rekeyable lock key 36 is within the keyhole 56 in the rekeyable lock barrel 54. A second apparatus 88 is for unlocking and locking the tumbler pins 82 simultaneously within the sleeves 74, so that another rekeyable lock key 36 can be inserted within the keyhole 56 in the rekeyable lock barrel 54 to adjust and set the tumbler pins 82.

The lock mechanism changing structure 40 further includes a cam structure 90 mounted to the back of the barrel 46 of the master lock 24. When the barrel 46 is turned, the first apparatus 86 will lock the driver pins 72, while the second apparatus 88 will unlock the tumbler pins 82. When the barrel 46 is turned back, the first apparatus 86 will unlock the driver pins 72, while the second apparatus 88 will lock the tumbler pins 82.

The first locking and unlocking apparatus 86 includes each of the driver pins 72 having an annular groove 92 thereabout. A short rod 94 is pivotally mounted on shaft 96 to the back of the cylinder 42 of the master lock 24, so as to engage with the cam structure 90. A tapered arm 98 is pivotally affixed at 100 to the bottom end of the short rod 94 and extends into the back of the shell portion 58 of the rekeyable lock cylinder 50 to engage and disengage with each annular groove 92 on the driver pins 72. The position of the driver pins 72 when engaged will allow the rekeyable lock barrel 54 to rotate. When the lower pin assemblies 68 are disengaged the driver pins 72 will act as a stop for the lower pin assemblies 68 to become the proper length with the new rekeyable lock key 36.

Figures 9, 9A, 10, 11, 12:
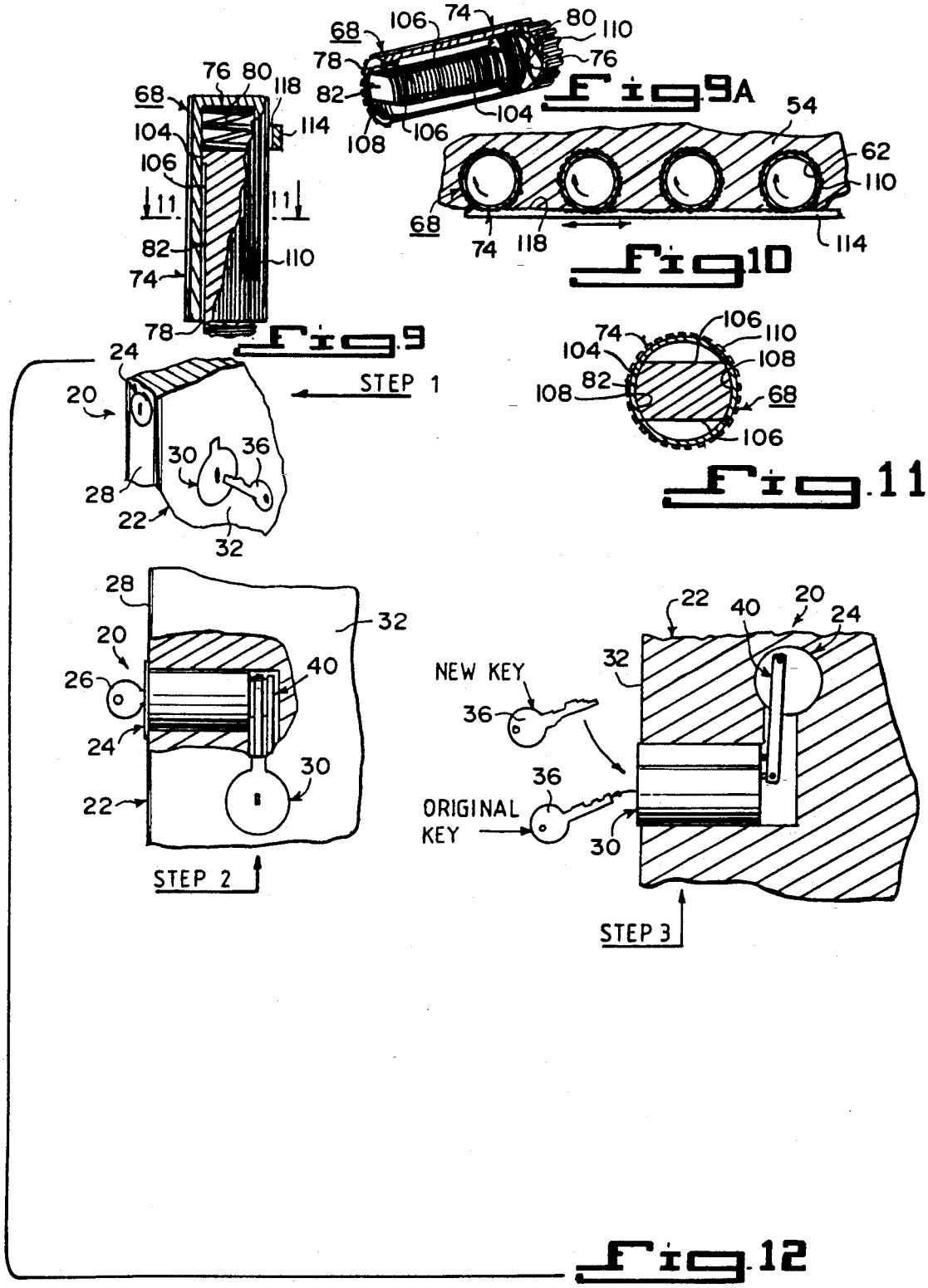
FIG. 9 is an elevational view with parts broken away of the lower pin assembly shown in FIG. 6B.
FIG. 9A is a perspective view with parts broken away of the lower pin assembly shown in FIG. 9.
FIG. 10 is a diagrammatic cross sectional view taken along line 10—10 in FIG. 7 of a portion thereof.
FIG. 11 is a diagrammatic cross sectional view taken along line 11—11 in FIG. 9.
FIG. 12 illustrates the various steps that must be taken to operate the instant invention.

The second unlocking and locking apparatus 88 includes each bore 62 in the rekeyable lock barrel 54 having two opposite flat sections 102. Each tumbler pin 82 is externally threaded at 104 and has two opposite flat sections 106 extending lengthwise more than half way therealong, so that each tumbler pin 82 can extend through one bore 62 in the rekeyable lock barrel 54 without rotating therein. Each sleeve 74 is threaded at two circumferentially spaced apart opposite areas 108 on its internal circumference and has teeth 110 formed about its external circumference to simulate a pinion gear. A long extensible rod 112 is pivotally mounted on the shaft 96 to the back of the cylinder 42 of the master lock 24, so as to engage with the cam structure 90. An elongated arm 114 is flexibly attached at 116 to the bottom end of the long extensible rod 112, so that the rekeyable lock barrel 54 will be able to rotate. The long extensible rod 112 can be fabricated out of a strong rubber material, so it can stretch when the rekeyable lock barrel 54 rotates. The elongated arm 114 has teeth 118 formed on its distal end to simulate a rack which extends into the barrel 54 of the rekeyable lock 30 and engages with the teeth 110 on all of the sleeves 74 to turn the sleeves 74. Part of the pins 82 remain outside of the sleeve 74 at all times and register with the flats 102 and raise and lower as elongated arm 114 turns sleeve 74. In viewing FIG. 9, the top of the pins 82 which do not have the flats 106 are not in threaded engagement in the sleeves, but may slide therein under spring bias 80. This allows each tumbler pin 82 to move in and out of its sleeve 74 under spring tension from the spring 80, so that the new rekeyable lock key 36 will form the new length of each of the lower pin assemblies 68 when inserted in the keyhole 56 in the rekeyable lock barrel.

The rekeyable lock system 20, as shown in the drawings, is mounted in the door 22. It can also be utilized in padlocks, gates, motor vehicle ignitions and the like and is not just limited to doors.

LIST OF REFERENCE NUMBERS

20 rekeyable lock system
22 door
24 master lock
26 master lock key for 24
28 side edge of 22
30 rekeyable lock
32 face of 22
34 lock mechanism
36 rekeyable lock key for 30
38 dead bolt in 28
40 length changing structure
42 master lock cylinder
44 aperture in 28
46 master lock barrel
48 keyhole in 46
50 rekeyable lock cylinder
52 aperture in 32
54 rekeyable lock barrel
56 keyhole in 54
58 shell portion on 50
60 bore in 58
62 bore in 54
64 upper pin assembly
68 lower pin assembly
70 spring in 60
72 driver pin
74 sleeve
76 closed top end on 74
78 open bottom end on 74
80 spring in 74
82 tumbler pin
84 elongated seat in 56
86 first locking and unlocking apparatus
88 second unlocking and locking apparatus
90 cam structure
92 annular groove in 72
94 short rod
96 pivot shaft between 42, 94 and 112
98 tapered arm
100 pivot between 94 and 98
102 flat section in 62
104 external threads on 82

106 flat section on 82
108 internal threaded area in 74
110 external teeth on 74
112 long extensible rod
114 elongated arm
116 flexible attachment
118 teeth on 114

It will be understood that each of the elements described above, or two or more together may also find a useful application in other types of methods differing from the type described above While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A rekeyable lock system which comprises:

a) a master lock activated by a master lock key, said master lock includes a cylinder and a barrel which fits into said cylinder, said barrel having a longitudinal keyhole so that said master lock key can be inserted into the keyhole in said barrel to rotate within said cylinder;

b) a rekeyable lock adjacent said master lock, said rekeyable lock having a lock mechanism activated by a rekeyable lock key, said rekeyable lock includes a cylinder, and a barrel which fits into said cylinder, said barrel having a longitudinal keyhole so that said rekeyable lock key can be inserted into the keyhole in said barrel to rotate within said cylinder, said lock mechanism within said rekeyable lock includes a shell portion formed along a top segment of said rekeyable lock cylinder, said shell portion having a plurality of spaced apart latitudinal bores therealong, said rekeyable lock barrel having a plurality of spaced apart latitudinal bores therealong in alignment with the latitudinal bores in said rekeyable lock cylinder, each of said rekeyable lock barrel bores intersect with the longitudinal keyhole in said rekeyable lock barrel, and a plurality of upper pin assemblies each placed within a bore in said shell portion of said rekeyable lock cylinder including a driver pin insertable into the respective bore in said shell portion of said rekeyable lock cylinder against a spring, a plurality of lower pin assemblies each placed within a bore in said rekeyable lock barrel so that when the proper rekeyable lock key is inserted into the keyhole in said rekeyable lock barrel said upper pin assemblies and said lower pin assemblies will be in their proper positions to allow said rekeyable lock barrel to rotate within said rekeyable lock cylinder, each said lower pin assembly includes a sleeve having a closed top end and an open bottom end, a spring insertable into the open bottom end of said sleeve, and a tumbler pin insertable into the open bottom end of said sleeve against said spring so that said tumbler pin can extend downwardly into the keyhole in said rekeyable lock barrel, further including an elongated seat formed on one side of the keyhole in said rekeyable lock barrel to prevent said lower pin assemblies from dropping completely down their respective said bores into the keyhole in said rekeyable lock barrel;

c) means operably extending from said master lock to said rekeyable lock for changing the length of the lock mechanism within said rekeyable lock so that a different rekeyable lock key can be utilized to operate said rekeyable lock, said lock mechanism changing means includes a first means for locking and unlocking said driver pins simultaneously when the proper rekeyable lock key is within the keyhole in said rekeyable lock barrel, and a second means for unlocking and locking said tumbler pins simultaneously with said sleeves so that another rekeyable lock key can be inserted within the keyhole in said rekeyable lock barrel to adjust and set said tumbler pins.

2. A rekeyable lock system as recited in claim 1, wherein said lock mechanism changing means further includes a cam structure mounted t the back of said barrel of said master lock, so that when said barrel is turned said first means will lock said driver pins, while said second means will unlock said tumbler pins, and when said barrel is turned back said first means will unlock said driver pins, while said second means will lock said tumbler pins.

3. A rekeyable lock system as recited in claim 2, wherein said first locking and unlocking means includes:

a) each of said driver pins having an annular groove thereabout;

b) a short rod pivotally mounted to the back of said cylinder of said master lock, so as to engage with said cam structure; and c) a tapered arm pivotally affixed to the bottom end of said short rod and extending into the back of said shell portion of said rekeyable lock cylinder to engage and disengage with each said annular groove on said driver pins, so that the position of said driver pins when engaged will allow said rekeyable lock barrel to rotate, and when said lower pin assemblies are unlocked said driver pins will act as a stop for said lower pin assemblies to become the proper length with a new rekeyable lock key.

4. A rekeyable lock system as recited in claim 3, wherein said second unlocking and locking means includes:

a) each said bore in said rekeyable lock barrel has two opposite flat sections;

b) each said tumbler pin being externally threaded and having two opposite flat sections extending lengthwise more than half way therealong, so that each said tumbler pin can extend through one said bore in said rekeyable lock barrel without rotating therein;

c) each said sleeve being threaded at two spaced apart opposite areas on its internal circumference, and having teeth formed about its external circumference to simulate a pinion gear;

d) a long extensible rod pivotally mounted to the back of said cylinder of said master lock, so as to engage with said cam structure; and e) an elongated arm flexibly attached to the bottom end of said long extensible rod, said elongated arm having teeth formed on its distal end to simulate a rack which extends into said barrel of said rekeyable lock and engages with the teeth on all of said sleeves to turn said sleeves, so as to allow each said tumbler pin to move in and out of its said sleeve under spring tension from said sleeve spring, so that said new rekeyable lock key will form the new length of each of said lower pin assemblies when inserted in the keyhole in said rekeyable lock barrel.

* * * * *